US005214480A

United States Patent [19]

Aoki et al.

[11] Patent Number: 5,214,480

[45] Date of Patent: May 25, 1993

[54] IMAGE FORMING APPARATUS WITH TRANSFER SHEET BEARING MEANS

[75] Inventors: Takao Aoki, Abiko; Yujiro Ando; Shinkichi Takahashi, both of Yokohama; Eihiro Sakaki, Chofu; Fumihiro Ueno, Yokohama; Toshiaki Miyashiro, Machida, all of Japan

[73] Assignee: Canon Kabushiki Kaisha, Tokyo, Japan

[21] Appl. No.: 946,014

[22] Filed: Sep. 15, 1992

Related U.S. Application Data

[63] Continuation of Ser. No. 641,906, Jan. 16, 1991, abandoned.

[30] Foreign Application Priority Data

Jan. 19, 1990 [JP] Japan ..... 2-9603

[51] Int. Cl.[5] ..... G03G 15/13

[52] U.S. Cl. ..... 355/274; 355/273; 355/326

[58] Field of Search ..... 355/273, 274, 276, 326, 355/277; 361/214

[56] References Cited

U.S. PATENT DOCUMENTS

| | | | |
|---|---|---|---|
| 3,847,478 | 11/1974 | Young | 355/274 |
| 3,992,557 | 11/1976 | Kubo et al. | 427/24 |
| 3,994,579 | 11/1976 | Iyer | 355/274 |
| 4,027,960 | 6/1977 | Ladrigan | 355/274 |
| 4,055,380 | 10/1977 | Borostyan | 355/273 |
| 4,063,808 | 12/1977 | Simpson | 355/274 |
| 4,072,412 | 2/1978 | Suda et al. | 355/274 |
| 4,162,843 | 7/1979 | Inoue et al. | 355/274 X |
| 4,218,129 | 8/1980 | Ishimoto et al. | 355/272 |
| 4,248,951 | 2/1981 | Ando et al. | 355/219 X |
| 4,341,457 | 7/1982 | Nakahata et al. | 355/274 |
| 4,415,256 | 11/1983 | Inoue et al. | 355/274 |
| 4,445,772 | 5/1984 | Aoki et al. | 355/326 X |
| 4,504,137 | 3/1985 | Aoki et al. | 355/327 |
| 4,586,807 | 5/1986 | Yuasa | 355/271 |
| 4,674,860 | 6/1987 | Tokunaga et al. | 355/274 |
| 4,737,816 | 4/1988 | Inoue et al. | 355/274 X |
| 4,896,192 | 1/1990 | Kinoshita | 355/274 X |

FOREIGN PATENT DOCUMENTS 0117581 6/1986 Japan .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

The present invention provides an image forming apparatus having, an image bearing member; an image forming device for forming an image on the image bearing member; a transfer sheet bearing device for bearing and conveying a transfer sheet, to which a first voltage is applied for transferring the image formed on the image bearing member onto the transfer sheet born by the transfer sheet bearing device; and a discharging device for causing the discharge in the transfer sheet when the transfer sheet is separated from the transfer sheet bearing device, to which a second voltage having the same polarity as that of the first voltage and having a value equal to 80%-120% of the first voltage is applied.

27 Claims, 2 Drawing Sheets

IMAGE FORMING APPARATUS WITH TRANSFER SHEET BEARING MEANS

This application is a continuation of application Ser. No. 07/641,906 filed Jan. 16, 1991, now abandoned.

BACKGROUND OF THE INVENTION

1. Field of the Invention

This present invention relates to an electrophotographic or electrostatic image forming apparatus wherein a developed image (toner image) is formed on an image bearing member and the toner image is transferred onto a transfer sheet to obtain an image. More particularly, this present invention is preferably embodied as a multi-color image forming apparatus having a transferring device for sequentially transferring a plurality of color toner images sequentially formed on the image bearing member onto the transfer sheet to superimpose the toner images on the transfer sheet.

2. Related Background Art

In conventional transferring devices used in the image forming apparatus of this kind, an electrostatic transfer process such as a bias roller transfer process or a corona transfer process has been generally utilized.

In the bias roller transfer process, the toner image is transferred onto the transfer sheet, by applying the transfer bias voltage having a polarity opposite to that of the charge of the toner image formed on the image bearing member to a transfer roller having a conductive layer acting as a transfer sheet bearing member. Alternatively, in place of the transfer roller, an endless belt having the conductive layer may be used.

On the other hand, in the corona transfer process, a dielectric film such as a polyester film is used as the transfer sheet bearing member, a transfer drum is formed by wrapping the film on a cylinder having a large undercut on its peripheral surface, and the toner image is transferred onto the transfer sheet by applying the corona discharge to the film from the inside of the transfer drum. Alternatively, in place of the transfer drum, an endless belt made of a dielectric film may be used.

In the conventional transferring device utilizing the above-mentioned bias roller transfer process, after the transferring operation has been finished, when the transfer sheet is separated from the transfer roller, there arises the discharge in the air (atmosphetic discharge), thus scattering the toner image on the transfer sheet, with the result that the image is distorted.

To cope with this problem, in the above-mentioned corona transfer process, for example, as disclosed in the Japanese Patent Laid-Open No. 61-117581, when the transfer sheet is separated from the transfer drum, the AC corona discharges are carried out from both transfer sheet side and the film side to remove the charges from the transfer sheet and the film, thereby reducing the atmospheric discharge during the separation of the transfer sheet to prevent the scattering of the toner image.

Incidentally, the bias roller transfer process has a structural advantage that the durability of the structure thereof is excellent and the structure is simple, in comparison with the corona transfer process; however, since the bias voltage is applied to the whole transfer roller, it is difficult to control the removal of the charge in the area where the transfer sheet is separated from the transfer roller, thus causing the scattering of the toner image easily.

SUMMARY OF THE INVENTION

The present invention aims to eliminate the above-mentioned conventional drawbacks, and an object of the present invention is to provide an image forming apparatus which can prevent the scattering of a toner image during the separation of a transfer sheet from a transfer sheet bearing surface, thereby obtaining a transferred image with high quality.

Another object of the present invention is to provide an image forming apparatus which can effectively remove the charge from the transfer sheet when the latter is separated from the transfer sheet bearing surface.

Other objects and features of the present invention will be apparent from the following description referring to the accompanying drawings.

DETAILED DESCRIPTION OF THE PREFERRED EMBODIMENTS

The present invention will now be fully explained with reference to the accompanying drawings.

Figure 1:
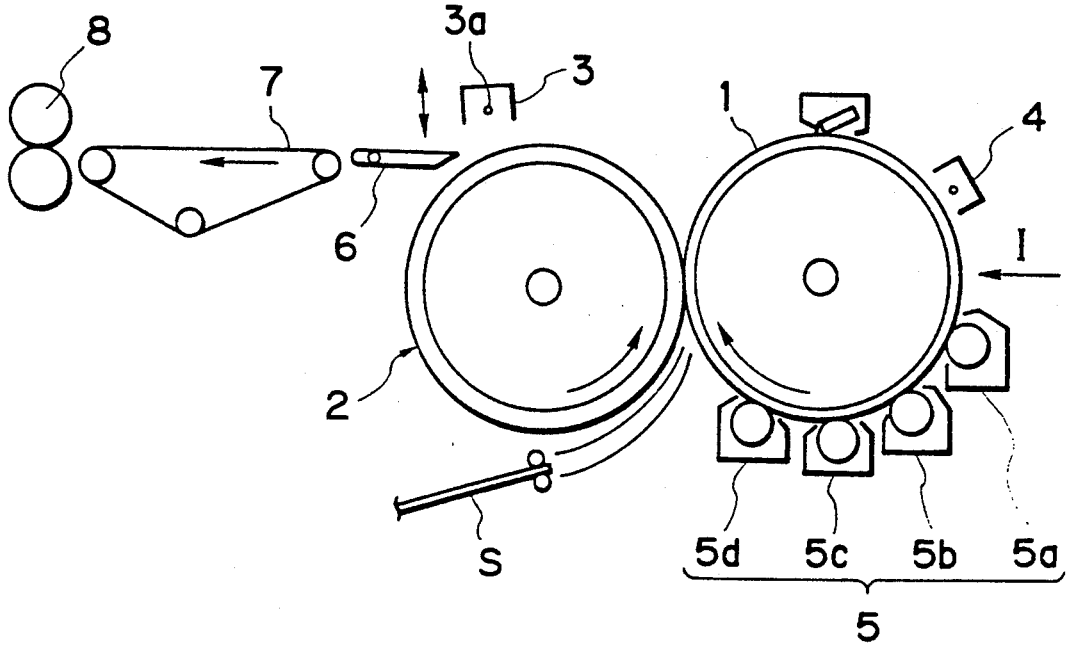
FIG. 1 is a schematic elevational view of an image forming apparatus according to a preferred embodiment of the present invention.

In a preferred embodiment shown in FIG. 1, an image forming apparatus according to the present invention is embodied as an electrophotographic color printer.

In FIG. 1, the electrophotographic color printer includes an image bearing member or drum-shaped OPC photosensitive member 1 rotated in a direction shown by the arrow. Around the photosensitive member 1, there are disposed a corona discharger 4 for charging the photosensitive member 1 with a predetermined polarity, a laser beam exposure means I for forming an electrostatic latent image on the photosensitive member 1, and a plurality of developing devices 5 for developing the latent image formed on the photosensitive member 1 with toner having different colors (In the illustrated embodiment, four developing devices 5*a*, 5*b*, 5*c* and 5*d* are provided).

A visualized image or toner image formed on the photosensitive member 1 is rotated together with the photosensitive member 1 and is transferred onto a transfer sheet S (normally, transfer paper S) with the aid of a transferring device comprising a transfer roller 2 to which a bias voltage is applied. Then, the transfer paper S is treated so that the charges accummulated thereon by means of a corona discharger 3 are removed; thereafter, the transfer paper is separated from the transfer roller 2 by means of a separating claw 6, and is sent to a fixing device 8 by means of a conveying belt 7. The corona discharger 3 also acts to remove the charges accummulated on the transfer roller 2.

Figure 2:
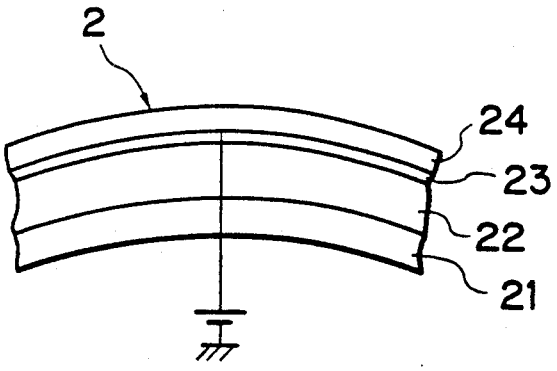
FIG. 2 is an enlarged sectional view of a part of a transfer roller of the apparatus of FIG. 1.

As shown in FIG. 2, the transfer roller 2 comprises an inner elastic layer 22 having a thickness of 5 mm formed on a cylinder 21 acting as a substrate and adapted to urge the transfer paper S against the photosensitive member 1, an intermediate conductive layer 23 (having a volume resistance of $1\times10^8$ Ω·cm or less) having a thickness of 10 μm and acting as an electrode for applying a transfer bias voltage, and an outer resistance layer 24 (having a volume resistance of $1\times10^8$ Ω·cm or more) having a thickness of 30 μm and adapted to maintain the charges on the surface of the transfer roller to hold the transfer paper S on the transfer roller. More specifically, the cylinder 21 was made of aluminium material, elastic layer 22 was made of urethane sponge material, conductive layer 23 was made of aluminium material, and resistance layer 24 was made of PVdF (polyvinylidene fluoride) material having the volume resistance of $10^{13}$–$10^{15}$ Ω·cm.

Figure 3:
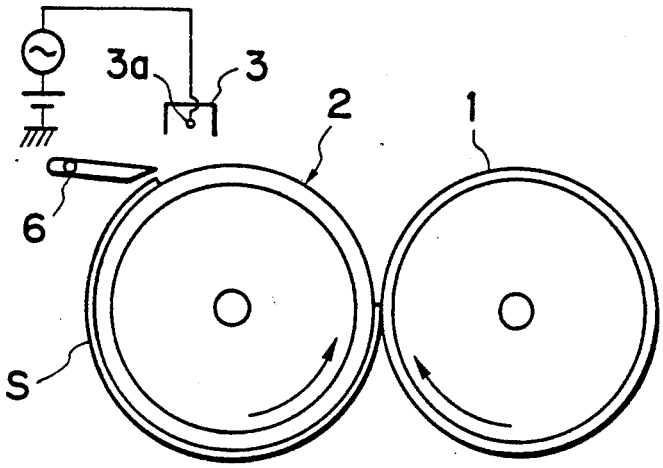
FIG. 3 is an elevational view, similar to FIG. 1, for explaining the position of installation of a corona discharger.

As shown in FIG. 3 (similar to FIG. 1, but only main portions are shown and others are omitted), a peripheral length of the transfer roller 2 is so selected that, when a leading end of the transfer paper S wrapped around the transfer roller 2 reaches a transfer start position (an entrance of a nip formed between the photosensitive member 1 and the transfer roller 2), a trailing end of the transfer paper S is positioned out of an illumination area of the corona discharger 3 as will be described later.

The corona discharger 3 is disposed near the transfer roller 2 so long as the corona discharger 3 does not contact the transfer paper S, thus not interfering with the separation of the transfer sheet from the transfer roller. Preferably, a distance between a discharge wire 3*a* of the corona discharger 3 and the surface of the transfer roller 2 is selected to have a value of 10 mm–15 mm.

Next, an operation of the image forming apparatus will be explained.

First of all, the photosensitive member 1 having a negative charging polarity is charged with the negative polarity by means of the corona discharger 4, and a first electrostatic latent image is formed on the photosensitive member 1 by reducing the charging potential on the photosensitive member by the exposure by means of the laser beam exposure means I in response to image information. Then, for example by means of the developing device 5*a*, a potential-reduced portion of the first electrostatic latent image is reversely developed, thus forming a first toner image of a magenta color negatively charged, on the photosensitive member 1. On the other hand, the transfer paper S is supplied at a predetermined timing, and a transfer bias voltage of 1.8 Kv having the polarity (for example, positive polarity) opposite to that of the toner is applied to the conductive layer 23 of the transfer roller 2 immediately before the leading end of the transfer paper reaches the transfer start position, thus transferring the first toner image onto the transfer paper S and electrostatically absorbing the transfer paper S on the surface of the transfer roller 2.

Then, similar to the formation of the first electrostatic latent image, a second electrostatic latent image is formed on the photosensitive member 1 by the laser beam exposure means I, and, thereafter, a second toner image having a color (for example, cyan) different from that of the first toner image and negatively charged is formed on the photosensitive member 1 by means of the developing device 5*b*. On the other hand, the transfer roller 2 bearing the transfer paper S thereon is rotated in an endless fashion. Thus, the second toner image is superimposed on the first toner image previously formed on the transfer paper S absorbed on and entrained by the transfer roller 2. In transferring the second color image, the bias voltage of +2.1 Kv is applied to the transfer roller 2 immediately before the leading end of the transfer paper reaches the transfer start position.

Similarly, third and fourth electrostatic latent images are formed on the photosensitive member 1 and are developed by the developing devices 5*c* and 5*d*, respectively; then, the third toner image (formed by yellow toner negatively charged) is superimposed on the second toner image formed on the transfer paper S and thereafter the fourth toner image (formed by black toner negatively charged) is superimposed on the third toner image, thus obtaining a four-color toner image on the transfer paper. In transferring the third and fourth toner images, the transfer bias voltages of +2.5 Kv and +3.0 Kv are applied to the transfer roller 2, respectively, immediately before the leading end of the transfer paper reaches the transfer start position, respectively.

The reason why the transfer bias voltage is gradually increased whenever the transferring of each different color toner image is effected in this way is to prevent the reduction in the efficiency of the transferring. A main factor for reducing the transferring efficiency is the fact that, when the transfer paper S is separated from the photosensitive member 1 after the transferring operation has been completed, the surface of the transfer paper S is charged with a polarity opposite to that of the transfer bias voltage (the surface of the transfer roller bearing the transfer paper is also slightly charged) and the charged charges are accummulated during each transferring of the image, and, if the transfer bias voltage is constant, the transfer electric field will be reduced every transferring of the image.

In transferring the fourth toner image, when (or immediately before or immediately after) the leading end of the transfer paper S reaches the transfer start position, a voltage obtained by overlapping the AC voltage with a DC bias voltage having the same polarity as and substantially the same value as the transfer bias voltage applied in the transferring of the fourth toner image is applied to the wire electrode 3*a* of the separating corona discharger 3. By applying the overlapped voltage to the wire electrode 3*a*, the corona discharger 3 generates an alternating electric field for the transfer paper, thus performing the positive discharge and the negative discharge alternatively. In this case, for example, the AC voltage is 5.5 Kv (effective value), frequency is 500 Kz, and DC bias voltage is +3.0 Kv which is the same voltage as that applied to the transfer roller 2 in the transferring of the fourth color image.

In the embodiment shown in FIG. 1, peripheral speed of the transfer roller 2 is 100 mm/sec; however, if the peripheral speed of the transfer roller 2 is in a range from 50 mm/sec to 200 mm/sec, the DC voltage will prefarably be 4 Kv–7 Kv (effective value) and the frequency will preferably be 50 Hz–800 Hz.

Further, the reason why the voltage having the same polarity as that of the transfer bias voltage is applied to the corona discharger 3 is to remove the charges having the polarity opposite to that of the transfer bias voltage and charged on the surface of the transfer paper S bearing the toner image after the transferring of the toner image as mentioned above. By removing the charges from the surface of the transfer paper S, it is possible to prevent the scattering of the toner image on the transfer paper S when the transfer paper S is separated from the transfer roller 2.

The DC bias voltage applied to the wire electrode 3*a* of the corona discharger 3 preferably has a value substantially the same as that of the transfer bias voltage, i.e., a value ranging from 80% to 120% of the transfer bias voltage immediately before the separation of the transfer paper from the transfer roller. That is to say, if the DC bias voltage is less than 80% of the transfer bias voltage, the charges will not completely be removed from the surface of the transfer paper S, thus reducing the efficiency for preventing the scattering of the toner. Whereas, if the DC bias voltage is greater than 120% of the transfer bias voltage, the surface of the transfer paper S will be charged with the same polarity as that of the transfer bias voltage, thus also reducing the efficiency for preventing the scattering of the toner.

The reason why the corona discharger 3 is activated when the leading end of the transfer paper S reaches the transfer start position in the transferring of the fourth toner image as mentioned above is to prevent the occurrence of the transferring unevenness. As in the conventional case, when the corona discharger is activated immediately before the leading end of the transfer paper reaches a separation position where the transfer paper is separated from the transfer sheet bearing member, since the discharging current flowed in the transfer roller 2 is earthed through an internal resistor of the transfer bias power source, if the internal resistor is high and a large amount of the discharging current flows, it is feared that the transferring unevenness occures immediately after the discharge is started. By the way, in the transferring of the full-color image as in the illustrated embodiment of the present invention, even if slight transferring unevenness occurs, it tends to be a striking contrast as the difference in colors. Accordingly, the activation of the corona discharger as described with reference to the illustrated embodiment is required.

Thereafter, as the leading end of the transfer paper S to which four color toner images have been transferred approaches the separation position, the separating claw 6 is activated so that a free end of the claw contacts the surface of the transfer roller 2, whereby the transfer paper S is separated from the transfer roller 2. The free end of the separating claw 6 is maintained to be contacted with the surface of the transfer roller 2 until the trailing end of the transfer paper S leaves the transfer roller 2, and, thereafter, is returned to an original retracted position. As mentioned above, the corona discharger 3 is activated from the time when the leading end of the transfer paper S reaches the transfer start position for the transferring of the last color toner image to the time when the trailing end of the transfer paper S leaves the transfer roller 2, thereby removing the charges (having the same polarity as that of the toner) accummulated on the transfer paper S and the charges (having the polarity opposite to that of the toner) created on the conductive layer of the transfer roller 2 due to such accummulated charges, with the result that the transfer paper S can be easily separated from the transfer roller by means of the separating claw 6 and the atmospheric discharge is reduced during the separating operation.

Incidentally, when the trailing end of the transfer paper S reaches a transfer completion position (i.e., an exit of the nip formed between the photosensitive member 1 and the transfer roller 2), the transfer bias voltage being applied to the transfer roller 2 is turned OFF (i.e., turned to an earth potential). At the same time, the bias voltage being applied to the corona discharger 3 is also turned OFF, for preventing the occurrence of a problem described below.

That is to say, if the transfer bias voltage is still being applied to the transfer roller when a portion of the transfer roller 2 which does not bear the transfer paper S contacts the photosensitive member 1 directly, particularly in the case of the reverse development as in the illustrated embodiment, if the charged polarity of the photosensitive member 1 (charged polarity of the corona discharger 4) is opposite to the polarity of the transfer bias voltage, the photosensitive member 1 will be charged with the polarity same as that of the transfer bias voltage in comparison with an area (of the photosensitive member) contacting the transfer roller 2 through the transfer paper S, thus causing the charging memory; accordingly, when the image forming operation is effected using a transfer paper of different size, there arises a problem that a ghost image regarding the transfer paper of the previous size can easily be generated.

In particular, as mentioned above, when the OPC photosensitive member having the negative charging polarity is used as the photosensitive member, even if the photosensitive member is pre-exposed before the image forming operation is started, the charging memory can easily be caused.

Further, the reason why the bias voltage of the corona discharger 3 is turned OFF at the same time when the transfer bias voltage is turned OFF as mentioned above is to make the charge removing condition during the separation of the transfer paper S to equalize to the charge removing condition during the transferring of the last color toner image. That is to say, if the bias voltage of the corona discharger 3 is constant, when the transfer bias voltage is turned OFF, the transfer paper S is charged in the course of the separating and charge removing operation, which makes the prevention of the scattering of the toner impossible.

In place of the fact that the transfer bias voltage is turned OFF when the trailing end of the transfer paper S reaches the transfer completion position as mentioned above, the transfer bias voltage may be changed to a predetermined small voltage, for example, +1.0 Kv or less, which does not cause the above-mentioned ghost image. In this case, in synchronous with the transfer bias voltage, the bias voltage applied to the corona discharger 3 is changed to be a voltage (having the same polarity as that of the predetermined voltage) substantially the same as that of the transfer bias voltage (for example, 80%–120% of the transfer bias voltage).

Figure 4:
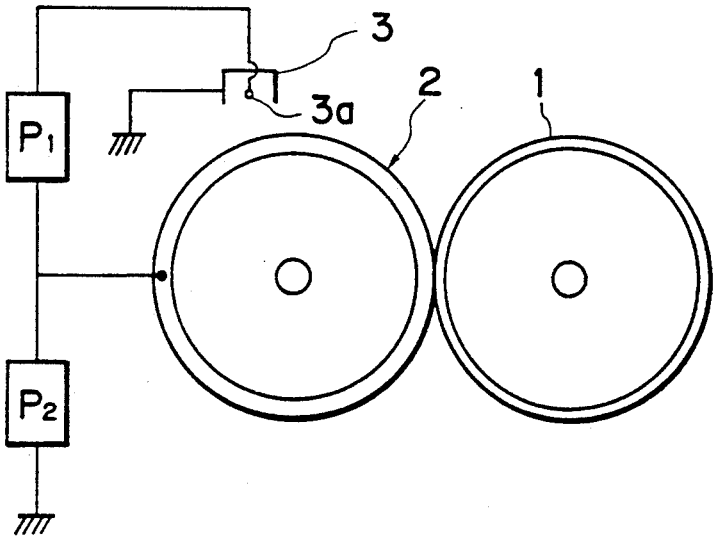
FIG. 4 is a constructural view showing the connections of an AC power source ($P_1$) and a transfer bias power source ($P_2$)

The control of the bias voltage for the corona discharger 3 can be performed by controlling an exclusive DC power source connected to the AC power source. However, as shown in FIG. 4 illustrating the connection between the power sources, the construction can be simplified by connecting the AC power source $P_1$ to the transfer bias power source $P_2$ in series and by sequence-controlling the ON/OFF control of the power sources or the voltage level control.

As mentioned above, after the transfer paper S is separated from the transfer roller 2, it is sent, by means of the conveying belt 7, to the thermal fixing device 8, where the toner images on the transfer paper S are fixed onto the transfer paper by fusing and mixing the toner, thus forming four full-color image.

It was found that the full-color image obtained by the present invention was a sharp image without scattering the toner.

Figure 5:
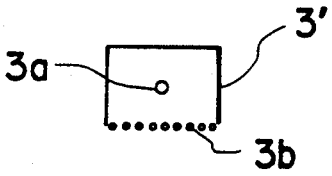
FIG. 5 is an explanatory view showing a corona discharger according to another embodiment.

As another embodiment of the present invention, in place of the separating corona discharger 3 shown in FIG. 1, a corona discharger 3' as shown in FIG. 5, can be used. The corona discharger 3' has grid electrodes acting as control electrodes for controlling the discharge of the corona discharger, which grid electrodes comprise a plurality of grid wires **3*b*** arranged in a shield opening and spaced apart at a distance of 1 mm–2 mm in the illustrated embodiment.

In FIG. 1, the first toner image having the predetermined color is formed on the photosensitive member 1, and the transfer bias voltage of 1.8 Kv having the polarity opposite to that of the toner is applied to the transfer roller 2 immediately before the leading end of the transfer paper supplied at a predetermined timing reaches the transfer start position, thus transferring the first toner image onto the transfer paper S and electrostatically absorbing the transfer paper S on the transfer roller 2. Then, the second image having the different color from that of the first toner image is formed on the photosensitive member 1, and this second toner image is superimposed on the first toner image previously formed on the transfer paper S.

In transferring the second color image, the bias voltage of +2.1 Kv is applied to the transfer roller 2 immediately before the leading end of the transfer paper S reaches the transfer start position, and at the same time, the DC voltage of +5.5 Kv having the same polarity as that of the transfer bias voltage is applied to the discharge wire of the corona discharger 3' and the bias voltage of +2.52 Kv having the same polarity as that of the transfer bias voltage and being 120% of the latter is applied to the grid wires **3*b*. Similar to the voltage applied to the wire electrode of the corona discharger 3 as already mentioned, the DC voltage having the same polarity as that of the transfer bias voltage immediately before the separation of the transfer paper (+2.1 Kv) and substantially the same value as the latter, i.e., a value of 80%–120% of the transfer bias voltage may be applied to these grid wires 3*b***.

In this way, in the illustrated embodiment, by applying the voltage having the same polarity as that of the transfer bias voltage before the separation of the transfer paper and being larger than the transfer bias voltage to the wire electrode of the corona discharger 3' and by applying the voltage (80%–120% of the transfer bias voltage) having the same polarity as that of the transfer bias voltage and substantially the same as that of the transfer bias voltage value to the grid electrodes **3*b*, it is possible to obtain the same effect as that obtained by the corona discharger 3 in the embodiment shown in FIG. 3**.

After the transferring operation, when the leading end of the transfer paper S on which two color images were transferred reaches the separation position, the separating claw 6 protrudes in a transfer paper moving path so that the free end of the claw contacts the surface of the transfer roller 2, whereby the transfer paper S is separated from the transfer roller. The discharge of the corona discharger 3' is continued until the trailing end of the transfer paper S leaves the surface of the transfer roller 2.

Thereafter, the images transferred onto the separated transfer paper is fixed by the fixing device 8, thus forming the two-color image.

It was found that the two-color image obtained by the illustrated embodiment of the present invention was a sharp image without scattering the toner.

It should be noted that the present invention can preferably be embodied as not only the multi-color or two-color image forming apparatus as mentioned above but also a mono-color image forming apparatus as will be described hereinafter.

As shown in FIG. 3, according to the illustrated embodiment, the first toner image having the predetermined color is formed on the photosensitive member 1, and the transfer bias voltage of 1.8 Kv having the polarity opposite to that of the toner is applied to the transfer roller 2 immediately before the leading end of the transfer paper supplied at a predetermined timing reaches the transfer start position, thus transferring the first toner image onto the transfer paper S and electrostatically absorbing the transfer paper S on the transfer roller 2.

Thereafter, immediately before the leading end of the transfer paper S onto which the first color toner image is transferred reaches the separation position, the DC voltage of +5.5 Kv (frequency: 500 Kz) and the DC bias voltage of +1.44 Kv (voltage of 80% of the transfer bias voltage) are applied to the wire electrode **3*a* of the corona discharger 3. Substantially at the same time, the free end of the separating claw 6 contacts the surface of the transfer roller 2, thereby separating the transfer paper S from the transfer roller. The corona discharger 3 is activated until the trailing end of the transfer paper S leaves the surface of the transfer roller 2. The voltage applied to the wire electrode of the corona discharger 3 may have a value which is similar to that applied to the corona discharger 3** during the separation of the transfer paper onto which the four color images are transferred and which is substantially the same value as the transfer bias voltage (+1.8 Kv) with the same polarity as the latter, i.e., a value of 80%–120% of the transfer bias voltage.

In case where the bias voltage applied to the corona discharger 3 is low and an amount of the discharging current is little in comparison with those in the transferring of the multi-color toner images, there is less transferring unevenness. Further, in the transferring of the mono-color toner image, since, even if there arises a little transferring unevenness, such transferring unevenness is not so noticeable, it is not necessary to activate the corona discharger 3 when the leading end of the transfer paper reaches the transfer start position.

Thereafter, the toner image on the separated transfer paper S is fixed, thus forming the mono-color image. It was found that the mono-color image obtained by the illustrated embodiment was a sharp image without scattering the toner.

Incidentally, in the above-mentioned embodiments, it should be noted that the AC voltage supplied by the AC power source is a voltage which periodically varies its voltage value from plus to minus or vice versa alternatively and includes a square wave voltage formed by periodically turning the DC power source ON and OFF.

As mentioned above, the image forming apparatus according to the present invention can provide a good image without scattering the toner by effectively removing the charges from the transfer paper during the separation of the transfer paper from the transfer sheet bearing surface, and can provide the mono-color, two-color or multi-color image with high quality without generating the transferring unevenness.

What is claimed is:

1. An image forming apparatus comprising:

an image bearing member;

an image forming means for forming an image on said image bearing member;

a transfer sheet bearing means for bearing and conveying a transfer sheet to a transfer position for the image formed on said image bearing member to be transferred to the transfer sheet as it is passed between said image bearing member and said transfer sheet bearing means, said transfer sheet bearing means having a dielectric layer disposed on a surface thereof and a conductive layer disposed inside of said dielectric layer, a first voltage being applied to the conductive layer upon a transfer operation; and a discharging means for causing the discharge in the transfer sheet when the transfer sheet is separated from said transfer sheet bearing means, to which a second voltage having the same polarity as that of said first voltage and having a value equal to 80%-120% of said first voltage is applied.

2. An image forming apparatus according to claim 1, wherein said discharging means comprises a corona discharging means having a wire electrode to which said second voltage is applied.

3. An image forming apparatus according to claim 1, wherein said discharging means causes the positive discharge and the negative discharge alternatively when said second voltage is being applied to said discharging means.

4. An image forming apparatus according to claim 2, wherein said discharging means causes the positive discharge and the negative discharge alternatively when said second voltage is being applied to said discharging means.

5. An image forming apparatus according to claim 1, wherein a DC voltage having the same polarity as the of said first voltage and having the value equal to 80%-120% of said first voltage is applied to said discharge means upon the separating operation.

6. An image forming apparatus according to claim 3, wherein a DC voltage having the same polarity as that of said first voltage and having the value equal to 80%-120% of said first voltage is applied to said discharge means upon the separating operation.

7. An image forming apparatus according to claim 5, wherein said second voltage is a voltage obtained by overlapping a DC voltage with an AC voltage.

8. An image forming apparatus according to claim 1, wherein said discharging means comprises a corona discharging means having a wire electrode to which a DC voltage having the same polarity as that of said first voltage is applied, and a control electrode for controlling the discharge of said discharging means, to which said second voltage is applied.

9. An image forming apparatus according to claim 1, wherein said discharging means is arranged so that a trailing end of the transfer sheet has passed through a discharging area of said discharging means when a leading end of the transfer sheet reaches a transfer position, and wherein said discharging means is activated when the leading end of the transfer sheet reaches the transfer position immediately before the separation of the transfer sheet.

10. An image forming apparatus according to claim 1, wherein said first voltage being applied to said conductive layer is turned OFF when the trailing end of the transfer sheet reaches the transfer position, and at the same time said second voltage being applied to said discharging is also turned OFF.

11. An image forming apparatus according to claim 1, wherein said first voltage being applied to said conductive layer is changed to a predetermined voltage when the trailing end of the transfer sheet reaches the transfer position, and at the same time said second voltage being applied to said discharging means is changed to a voltage substantially the same as said predetermined voltage.

12. An image forming apparatus according to claim 11, wherein said voltage substantially the same as said predetermined voltage has a value equal to 80%-120% of said predetermined voltage.

13. An image forming apparatus according to claim 1, wherein a plurality of images having different colors are formed on said image bearing member by means of said image forming means, and said plurality of images are successively superimposed on the transfer sheet born by said transfer sheet bearing means.

14. An image forming apparatus according to claim 1, wherein, after the transferring of the images, a full-color image is formed on the transfer sheet.

15. An image forming apparatus according to claim 13, wherein, after the transferring of the images, a full-color image is formed on the transfer sheet.

16. An image forming apparatus according to claim 14, wherein said first voltage is a voltage which is applied to said conductive layer in the transferring of the image immediately before the separation of the transfer sheet.

17. An image forming apparatus according to claim 1, further comprising a first power source connected between the conductive layer and ground for applying the first voltage and a second power source connected between said conductive layer and said discharge means, said first power source and said second power source being connected to each other in series.

18. An image forming apparatus, comprising:

an image bearing member;

image forming means for forming an image on said image bearing member;

transfer sheet bearing means for bearing and conveying a transfer sheet to a transfer position for the image formed on said image bearing member to be transferred to the transfer sheet as it is passed between said image bearing member and said transfer sheet bearing means, said transfer sheet bearing means having a dielectric layer disposed on a surface thereof and a conductive layer disposed inside of said dielectric layer;

discharge means for causing discharge of the transfer sheet while said transfer sheet is between said discharge means and said conductive layer;

a first power source connected between the conductive layer and ground for effecting image transferring operation; and a second power source between the conductive layer and said discharge means, said first power source and said second power source being connected to each other in series.

19. An image forming apparatus according to claim 18, wherein said discharge means applies discharge to the transfer sheet when the transfer sheet is separated from said transfer sheet bearing means.

20. An image forming apparatus according to claim 19, wherein the polarity of said first power source is same as that of the discharge of said discharge means.

21. An image forming apparatus according to claims 18, 19 or 20, wherein said first power source is a DC power source, and said second power source has an AC power source.

22. An image forming apparatus according to claim 21, wherein the power is supplied to said discharge means by said first and second power sources, when said discharge means carries out the discharge.

23. An image forming apparatus according to claim 19, wherein said discharge means is provided with a corona discharge means having a wire electrode, to which wire electrode said second power source is connected.

24. An image forming apparatus according to claim 18, wherein a plurality of images having different colors are formed on said image bearing member by means of said image forming means, and said plurality of images are successively superimposed on the transfer sheet born by said transfer sheet bearing means.

25. An image forming apparatus according to claim 24, wherein, after the transferring of the images, a full-color image has been formed on the transfer sheet.

26. An image forming apparatus according to claim 18, wherein said first power source supplied power to said conductive layer when the transfer sheet is existed between said image bearing member and said transfer sheet bearing means.

27. An image forming apparatus according to claims 1 or 19, further comprising a separation member for separating the transfer sheet from said transfer sheet bearing means by contacting the transfer sheet upon sheet separation.

* * * * *

UNITED STATES PATENT AND TRADEMARK OFFICE

CERTIFICATE OF CORRECTION

PATENT NO. : 5,214,480
DATED : May 25, 1993
INVENTOR(S) : Takao Aoki, et. al.

It is certified that error appears in the above-indentified patent and that said Letters Patent is hereby corrected as shown below:

Title page, item,
[54] TITLE
"SHEET BEARING MEANS" should read --AND SEPARATION VOLTAGE CONTROL--;

Title page, item,
[57] ABSTRACT
Line 7, "born" should read --borne--.

COLUMN 1
Line 3 "SHEET BEARING MEANS" should read --AND SEPARATION VOLTAGE CONTROL--.
Line 49, "(atmosphetic" should read --(atmospheric--;

COLUMN 2
Line 39, "constructional" should read --schematic--.
Line 58, "accummulated" should read --accumulated--.
Line 64, "accummulated" should read --accumulated--.

COLUMN 3
Line 13, "aluminium" should read --aluminum--.
Line 15, "aluminium" should read --aluminum--.

COLUMN 4
Line 34, "accummulated" should read --accumulated--.
Line 52, "Kz," should read --Hz,--.
Line 55, "peripheral" should read --a peripheral--.
Line 59, "prefarably" should read --preferably--.

UNITED STATES PATENT AND TRADEMARK OFFICE

CERTIFICATE OF CORRECTION

PATENT NO. : 5,214,480
DATED : May 25, 1993
INVENTOR(S) : Takao Aoki, et. al.

It is certified that error appears in the above-indentified patent and that said Letters Patent is hereby corrected as shown below:

COLUMN 5
Line 32, "occures" should read --occurs--.
Line 57, "accummulated" should read --accumulated--.
Line 60, "accummulated" should read --accumulated--.

COLUMN 6
Line 42, "In place," should read --In view--.
Line 48, "synchronous" should read --synchronism--.
Line 68, "four full-" should read --a four, full--.

COLUMN 7
Line 67, "is" should read --are--.

COLUMN 8
Line 22, "500 Kz)" should read --500Hz)--.

COLUMN 9
Line 38, "the of" should read --that of--.
Line 42, "claim 3," should read --claim 2,--.

COLUMN 10
Line 3, "discharging" should read --discharging means--.
Line 20, "born" should read --borne--.
Line 29, "14," should read --13,--.

COLUMN 11
Line 3, "same" should read --the same--.
Line 13, "19," should read --18,--.

UNITED STATES PATENT AND TRADEMARK OFFICE

CERTIFICATE OF CORRECTION

PATENT NO. : 5,214,480
DATED : May 25, 1993
INVENTOR(S) : Takao Aoki, et. al.

It is certified that error appears in the above-indentified patent and that said Letters Patent is hereby corrected as shown below:

COLUMN 12

Line 4, "born" should read --borne--.
Line 9, "supplied" should read --supplies--.
Line 10, "is existed" should read --is positioned--.

Signed and Sealed this

Fifth Day of April, 1994

Bruce Lehman

*Attest:*

BRUCE LEHMAN

*Attesting Officer*

*Commissioner of Patents and Trademarks*